US007143473B2

(12) United States Patent
Matsuki

(10) Patent No.: US 7,143,473 B2
(45) Date of Patent: Dec. 5, 2006

(54) DOOR CHECKER FOR AUTOMOBILE

(75) Inventor: Katsuhiro Matsuki, Saitama (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 11/034,208

(22) Filed: Jan. 13, 2005

(65) Prior Publication Data

US 2006/0150367 A1 Jul. 13, 2006

(51) Int. Cl.
*E05F 5/06* (2006.01)

(52) U.S. Cl. ..... 16/86 C; 16/82; 16/86 B; 292/277

(58) Field of Classification Search ..... 16/82, 16/85, 86 R, 86 A, 86 B, 86 C; 292/196, 292/273, 275, 262, 277, 278, 265, 269, DIG. 15, 292/DIG. 57, 146.1, 146.11, 146.12
See application file for complete search history.

(56) References Cited

U.S. PATENT DOCUMENTS 2,290,331 A * 7/1942 Jacobs ..... 16/86 C
2,291,412 A * 7/1942 Schonitzer ..... 16/86 C
5,474,344 A * 12/1995 Lee ..... 292/262
6,370,733 B1 * 4/2002 Paton et al. ..... 16/86 C
6,446,305 B1 * 9/2002 Kneeland ..... 16/82
6,467,126 B1 * 10/2002 Yezersky et al. ..... 16/86 C
6,813,811 B1 * 11/2004 Matsuki et al. ..... 16/86 B
6,871,382 B1 * 3/2005 Murayama et al. ..... 16/82
2003/0051312 A1 * 3/2003 Hoffman et al. ..... 16/50

FOREIGN PATENT DOCUMENTS

JP 11-303487 11/1999

* cited by examiner

*Primary Examiner*—Robert J. Sandy
*Assistant Examiner*—Michael J. Kyle
(74) *Attorney, Agent, or Firm*—Arent Fox PLLC

(57) ABSTRACT

A door checker for an automobile includes: a check lever 6; a case 1 through which the check lever 6 passes and which is fixed to a door D; and a shoe 19 which is housed in the case 1 and in sliding contact with detent surfaces 9 of the check lever 6. The check lever 6 includes: a core plate 6*a* made of a steel plate; and a synthetic resin skin 6*b* which is mold-connected to a peripheral surface of the core plate 6*a*. A full open stopper 12 for defining a full open position of the door D is provided in a distal end portion of the check lever 6. The full open stopper 12 includes: an anchor member 14 which passes through an anchor hole 13 formed in a distal end portion of the core plate 6*a*; and a bulging portion 15 formed integrally with the skin 6*b* so as to wrap the anchor member 14. Therefore, the structure of the full open stopper is simplified, and a process of installing the full open stopper can be eliminated from assembly.

1 Claim, 10 Drawing Sheets

DOOR CHECKER FOR AUTOMOBILE

BACKGROUND OF THE INVENTION

1. Field of the Invention

The present invention relates to a door checker for an automobile. More particularly, the present invention to an improvement of a door checker for an automobile, which includes: a check lever whose proximal end portion is connected via a shaft to a bracket fixed to a body of the automobile; a case through which the check lever passes and which is fixed to a door hinge-connected to the body; a shoe which is housed in the case and in sliding contact with detent surfaces of the check lever; and elastic members which are housed in the case and urge the shoe toward the detent surfaces, the check lever including a core plate made of a steel plate and a synthetic resin skin which is mold-connected to a peripheral surface of the core plate, and a full open stopper which comes into contact with the external end wall of the case to define a full open position of the door is provided in a distal end portion of the check lever.

2. Description of the Related Art

Such a door checker for an automobile has already been known as disclosed, for example, in Japanese Patent Application Laid-open No. 11-303487.

The full open stopper in this conventional door checker for an automobile includes: a stopper plate fitted at the outer periphery of a distal end portion of a core plate of a check lever; and an anchor pin inserted under pressure into an anchor hole in the distal end portion of the core plate to support the back surface of the stopper plate. Therefore, the number of parts and the number of assembling steps are relatively large, leading to difficulty in reducing the cost.

SUMMARY OF THE INVENTION

The present invention has been made in view of the above situation, and an object thereof is to provide a low-cost door checker for an automobile, in which the structure of a full open stopper can be simplified, and a process of installing the full open stopper can be eliminated from assembly.

To achieve the above object, according to the present invention, there is provided a door checker for an automobile, including: a check lever whose proximal end portion is connected via a shaft to a bracket fixed to a body of the automobile; a case through which the check lever passes and which is fixed to a door hinge-connected to the body; a shoe which is housed in the case and in sliding contact with detent surfaces of the check lever; and elastic members which are housed in the case and urge the shoe toward the detent surfaces, the check lever including a core plate made of a steel plate and a synthetic resin skin which is mold-connected to a peripheral surface of the core plate, and a full open stopper which comes into contact with the external end wall of the case to define a full open position of the door is provided in a distal end portion of the check lever, characterized in that the full open stopper includes: an anchor member disposed so as to pass through an anchor hole formed in a distal end portion of the core plate; and a bulging portion formed integrally with the skin so as to wrap the anchor member.

The elastic member corresponds to a rubber spring 20 in the later-described embodiment of the present invention, and the anchor member corresponds to an anchor pin 14 therein.

According to the above-described feature, since the bulging portion that wraps the anchor member is molded integrally with the synthetic resin skin of the check lever, the full open stopper can be formed simultaneously with the manufacture of the check lever. Therefore, when the door checker is assembled, the number of assembling steps can be decreased by eliminating a process of installing the full open stopper. Moreover, the bulging portion is used not only as a stopper plate but also as an element for preventing the anchor member from coming off from the core plate. Therefore, the number of parts is decreased, and the structure is simplified, which effectively reduces the cost owing to the reduced number of assembling steps.

These and other objects, features, and advantages will become more apparent in the explanation of preferred embodiment described in detail below with reference to the accompanying drawings.

DESCRIPTION OF THE PREFERRED EMBODIMENT

A preferred embodiment of the present invention will now be described with reference to the accompanying drawings.

Figure 1:
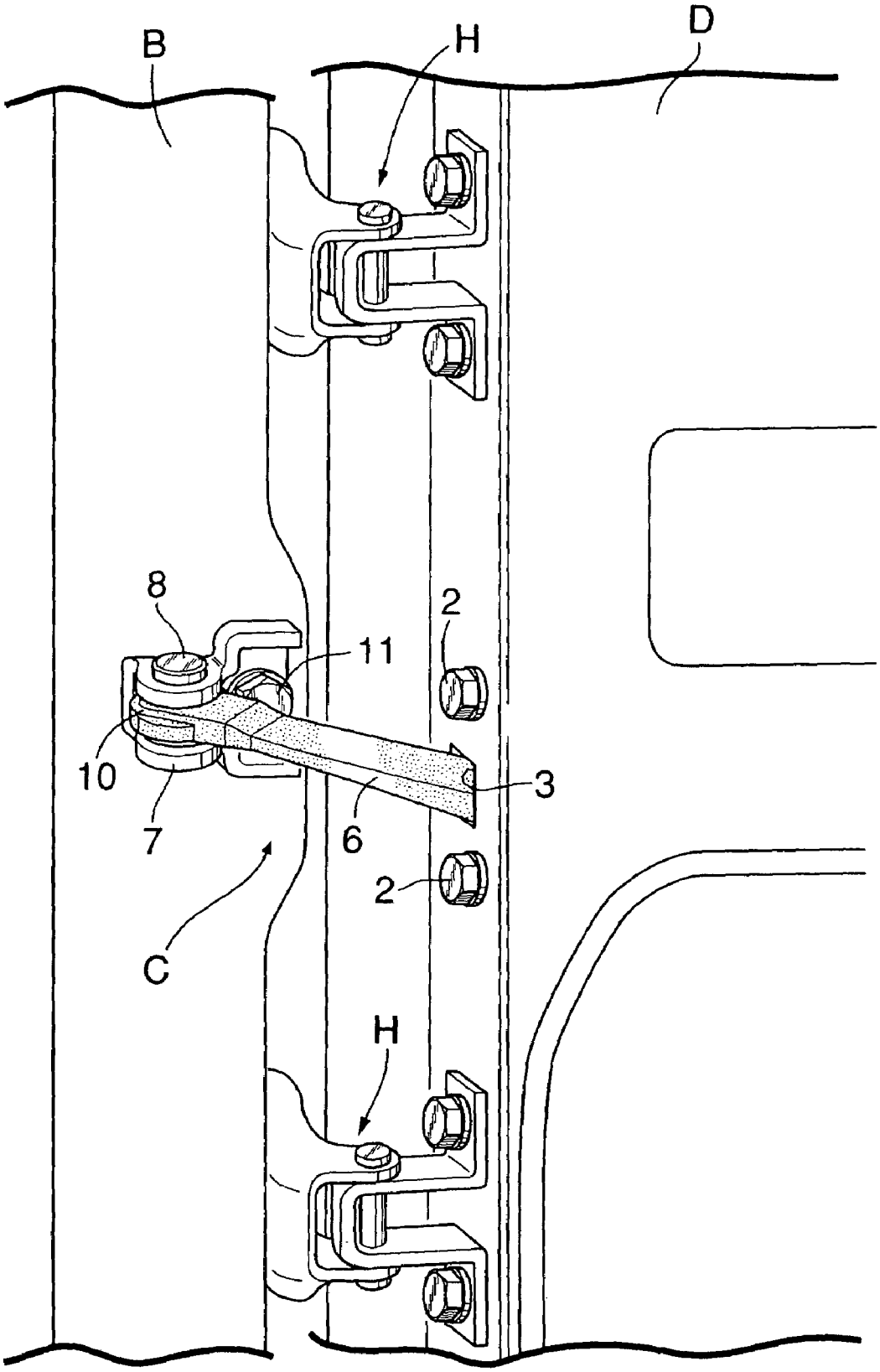
FIG. 1 is a perspective view of an essential portion of an automobile provided with a door checker in accordance with an embodiment of the present invention.

First, in FIG. 1, a door D is connected to a vehicle body B via hinges H so as to be turnable to open and close an entrance/exit opening in the vehicle body B. A door checker C in accordance with the present invention for the door D is installed between the body B and the door D.

Figure 2:
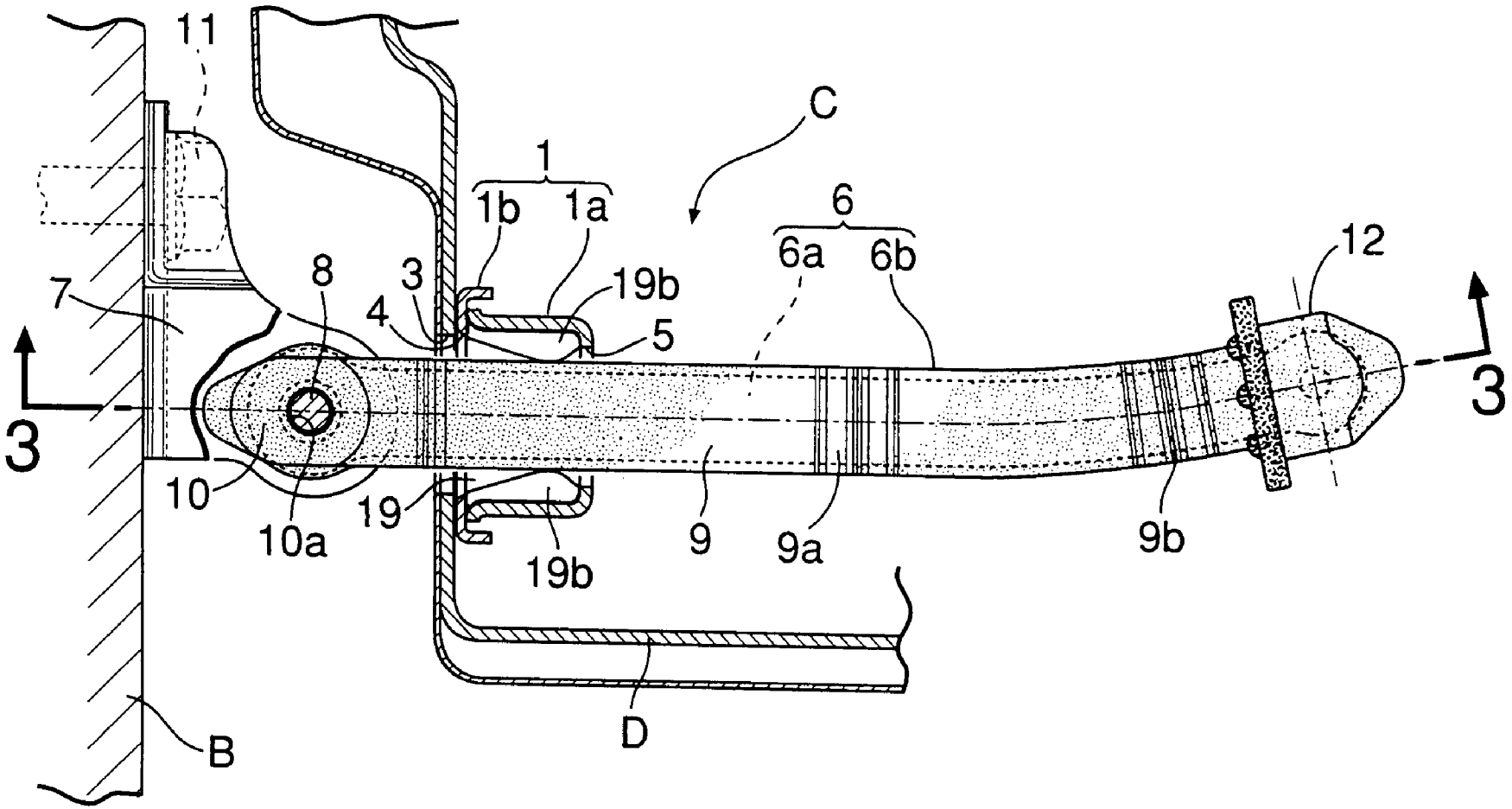
FIG. 2 is a plan view of the door checker.
Figure 3:
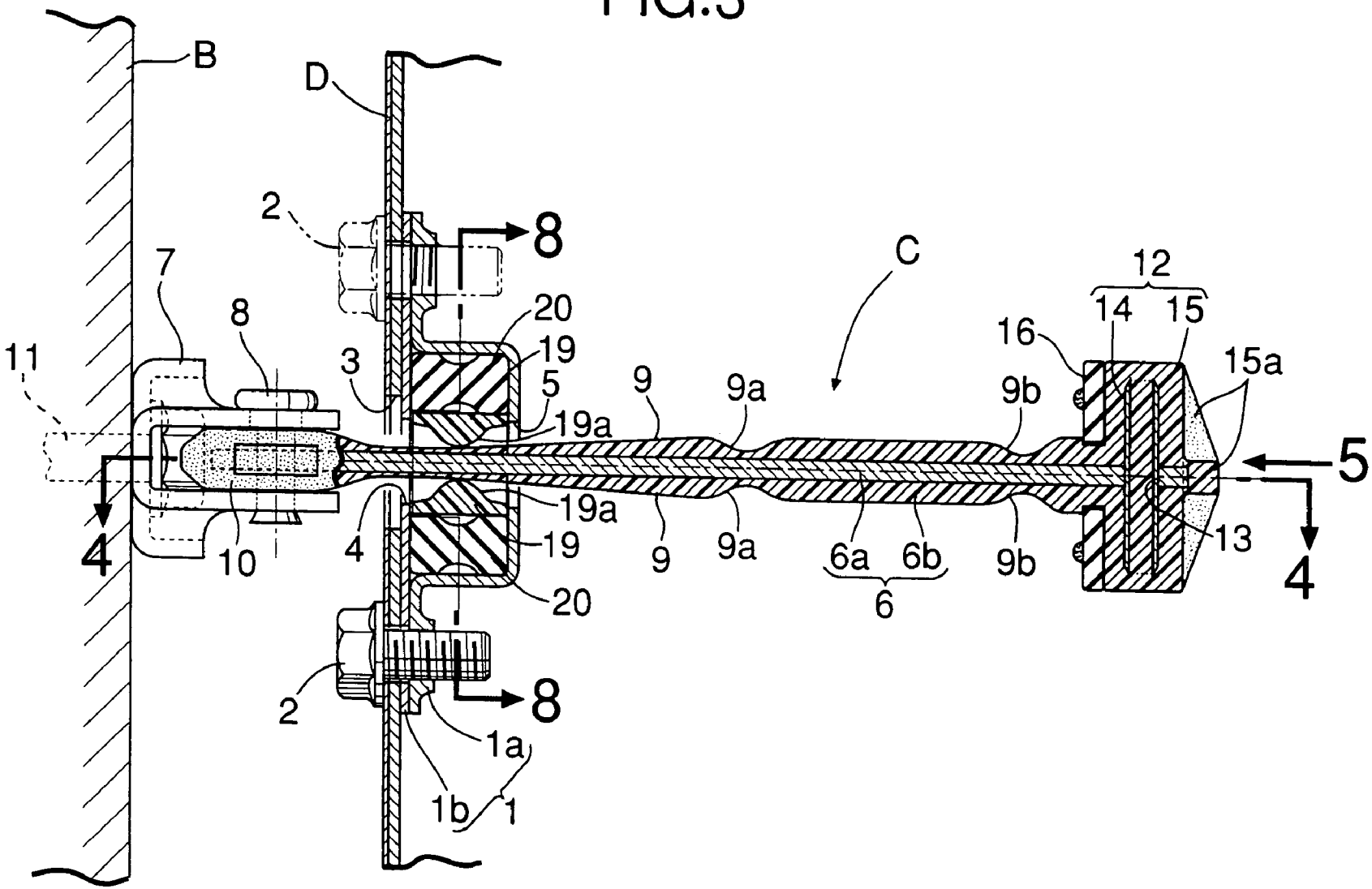
FIG. 3 is a sectional view taken along the line 3—3 of FIG. 2.

As shown in FIGS. 2 and 3, the door checker C has a case 1 fixed to the internal surface of an end wall of the door D with a plurality of bolts 2, 2. The case 1 includes: a case body 1*a* of a box shape whose one end is open; and a cover 1*b* which is connected to the case body 1*a* so as to cover the open end of the case body 1*a* and which is held between the case body 1*a* and the inner surface of the end wall of the door D. The cover 1*b* and the case body 1*a* are formed with through holes 4 and 5, respectively, which are arranged coaxially with a through hole 3 formed in the end wall of the door D. A check lever 6 is provided so as to pass through these three through holes 3, 4 and 5.

The check lever 6 has a boss 10 at the proximal end projecting outward from the door D. The boss 10 is connected turnably to a bracket 7 via a shaft 8 inserted into a shaft hole 10*a* of the boss 10. The bracket 7 is fixed to the body D with a plurality of bolts 11, 11 so that the shaft 8 is parallel with pivot shafts of the hinges H.

The check lever 6 includes: a core plate 6*a* made of a steel plate; and a synthetic resin skin 6*b* mold-connected to the peripheral surface of the core plate 6*a*. The skin 6*b* is formed so that the thickness of the check lever 6 gradually increases from a neck portion of the boss 10 toward an intermediate portion of the lever 6. Opposite surfaces arranged in the thickness direction of the check lever 6 are detent surfaces 9, 9. On the detent surfaces 9, 9, a half open detent notch 9*a* and a full open detent notch 9*b* are formed in that order from the boss 10 side. A full open stopper 12 adjacent to the full open detent notch 9*b* is provided integrally in a distal end portion of the check lever 6.

Figure 4:
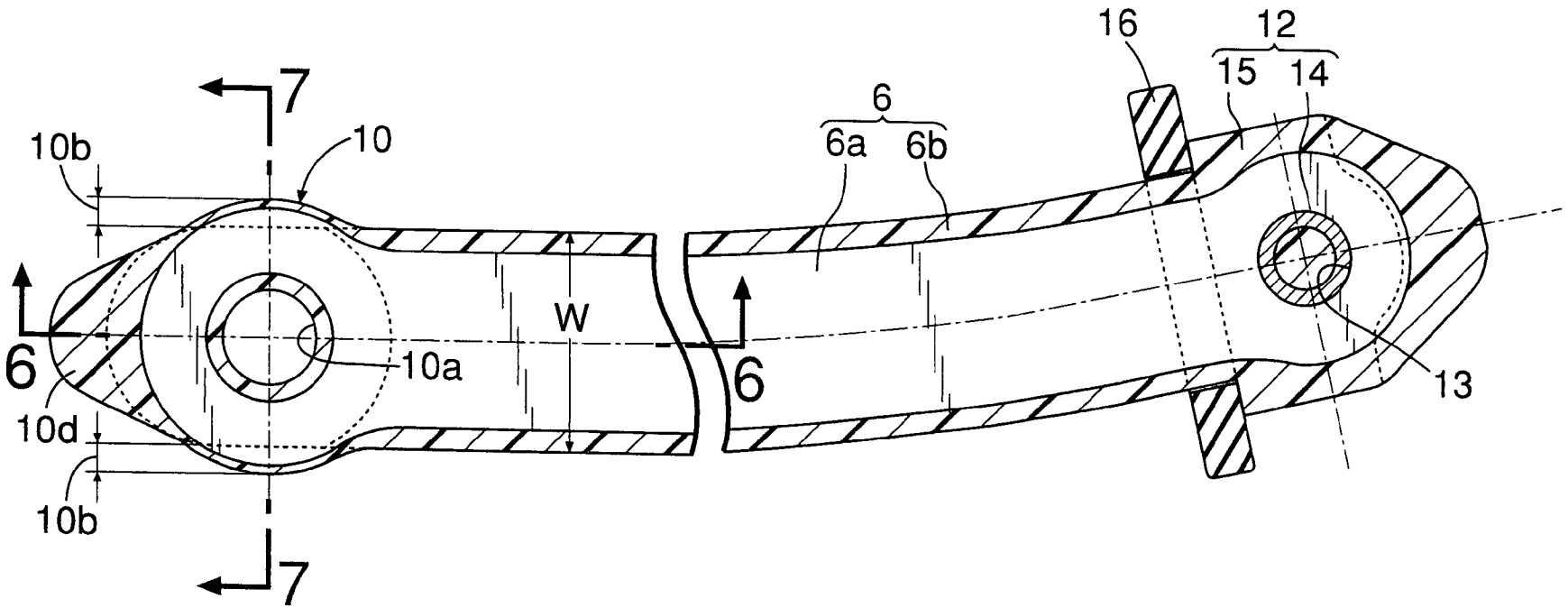
FIG. 4 is an enlarged sectional view of a check lever taken along the line 4—4 of FIG. 3.
Figure 5:
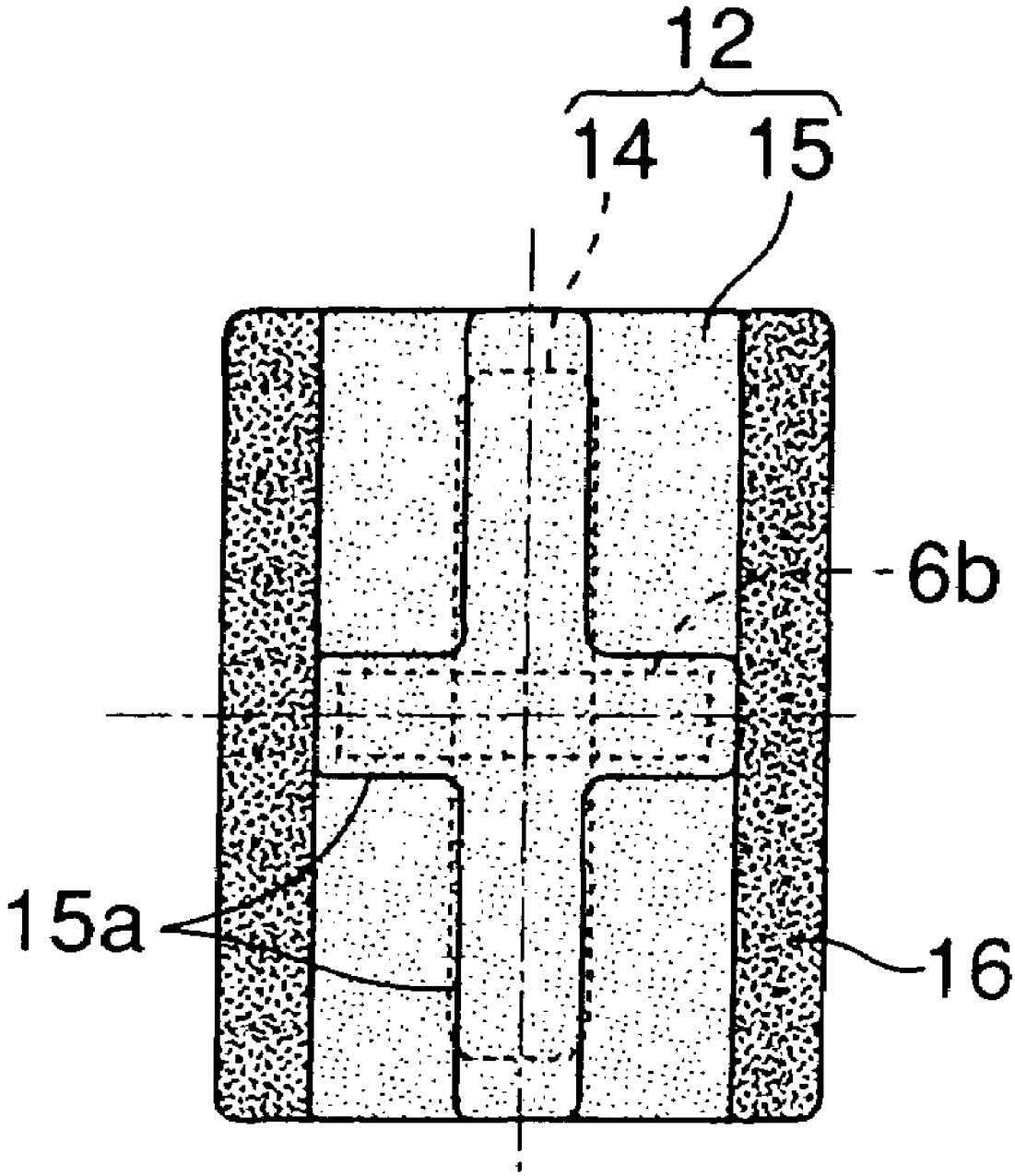
FIG. 5 is a view taken in the direction of the arrow 5 of FIG. 3.

As shown in FIGS. 4 and 5, the full open stopper 12 includes: a hollow anchor pin 14 which is fitted in a pin hole 13 formed in a distal end portion of the core plate 6*a* and whose opposite ends project from the core plate 6*a*; and a synthetic resin bulging portion 15 which is charged into a hollow portion of the anchor pin 14 and mold-connected to the peripheral surfaces of the distal end of the core plate 6*a* and the anchor pin 14 so as to connect the distal end of the core plate 6*a* and the anchor pin 14 to each other. The bulging portion 15 is formed integrally with the skin 6*b*. The sectional shape of the bulging portion 15 in the direction perpendicular to the lengthwise direction of the check lever 6 is a rectangular shape in which the axial direction of the anchor pin 14 is the long side. A cross-shaped reinforcing rib 15*a* is integrally formed on the external end face of the bulging portion 15. A plate-shaped rubber cushion member 16, which is fitted on the check lever 6 and faces the case 1, is disposed on the internal end surface of the bulging portion 15. By bringing the outside surface of the case 1 into contact with the bulging portion 15 via the cushion member 16, the full open of the door D is defined.

As shown in FIGS. 2, 3, 8 and 9, the case 1 houses a pair of synthetic resin shoes 19, 19 which are in sliding contact with both the detent surfaces 9, 9 of the check lever 6, and a pair of rubber springs 20, 20 which urge the shoes 19, 19 toward the detent surfaces 9, 9. Each of the rubber springs 20, 20 is mounted, in a compressed state, between positioning concave portions 21, 21 on the back surface of the shoe 19 and the internal wall of the case 1 facing the positioning concave portions 21, 21.

Each of the shoes 19, 19 is integrally formed with a semi-cylindrical engagement portion 19*a* which engages with the half open detent notch 9*a* and the full open detent notch 9*b*, and a pair of guide walls 19*b*, 19*b* which are in sliding contact with both side surfaces arranged in the width direction of the detent surfaces 9, 9 of the check lever 6.

Figure 6:
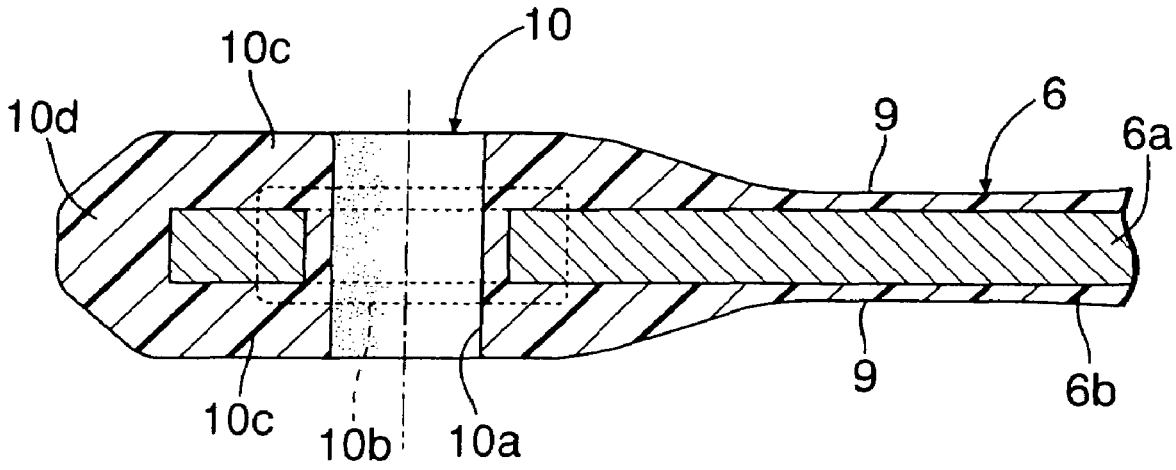
FIG. 6 is an enlarged sectional view taken along the line 6—6 of FIG. 4.
Figure 7:
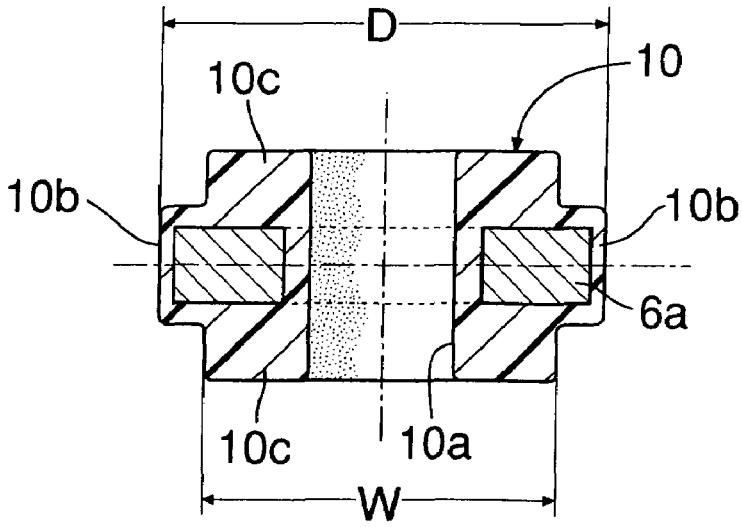
FIG. 7 is an enlarged sectional view taken along the line 7—7 of FIG. 4.
Figure 8:
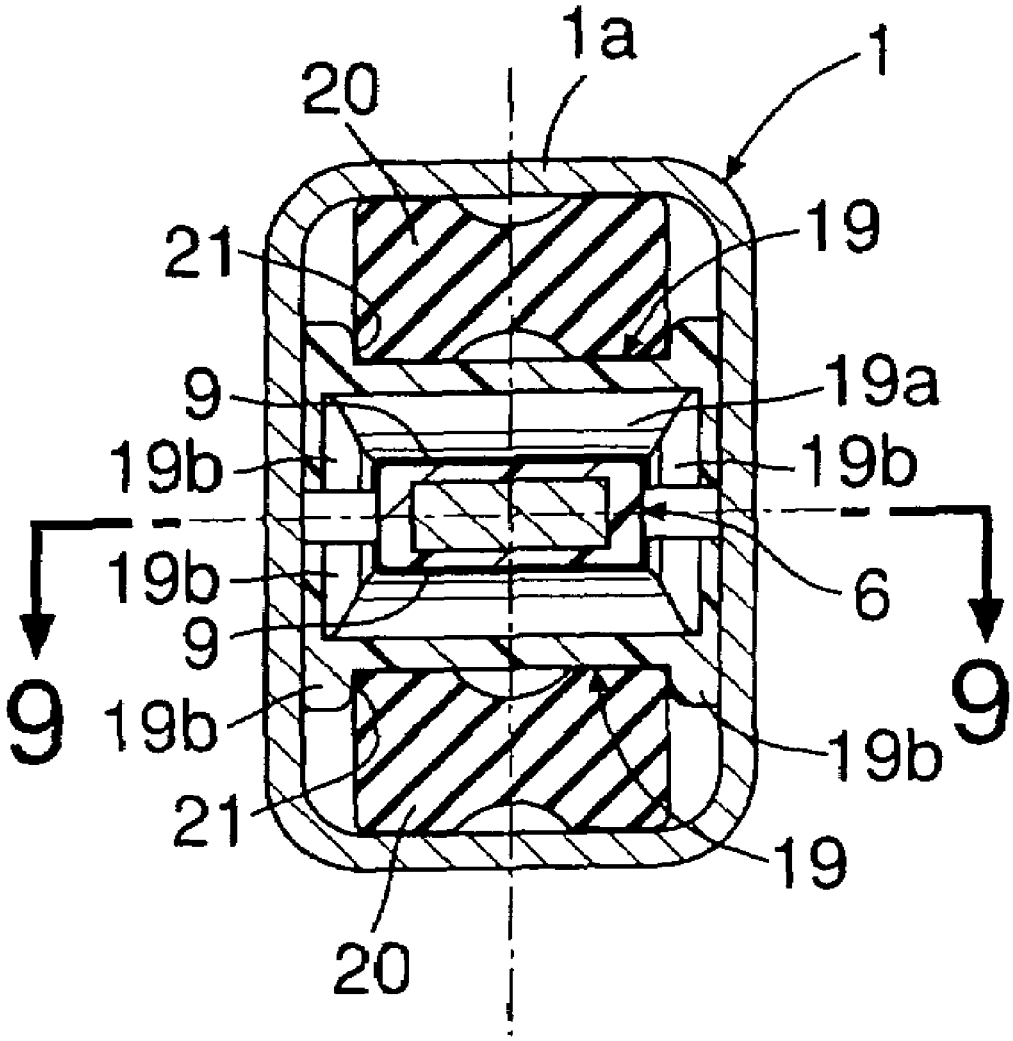
FIG. 8 is an enlarged sectional view taken along the line 8—8 of FIG. 3.
Figure 9:
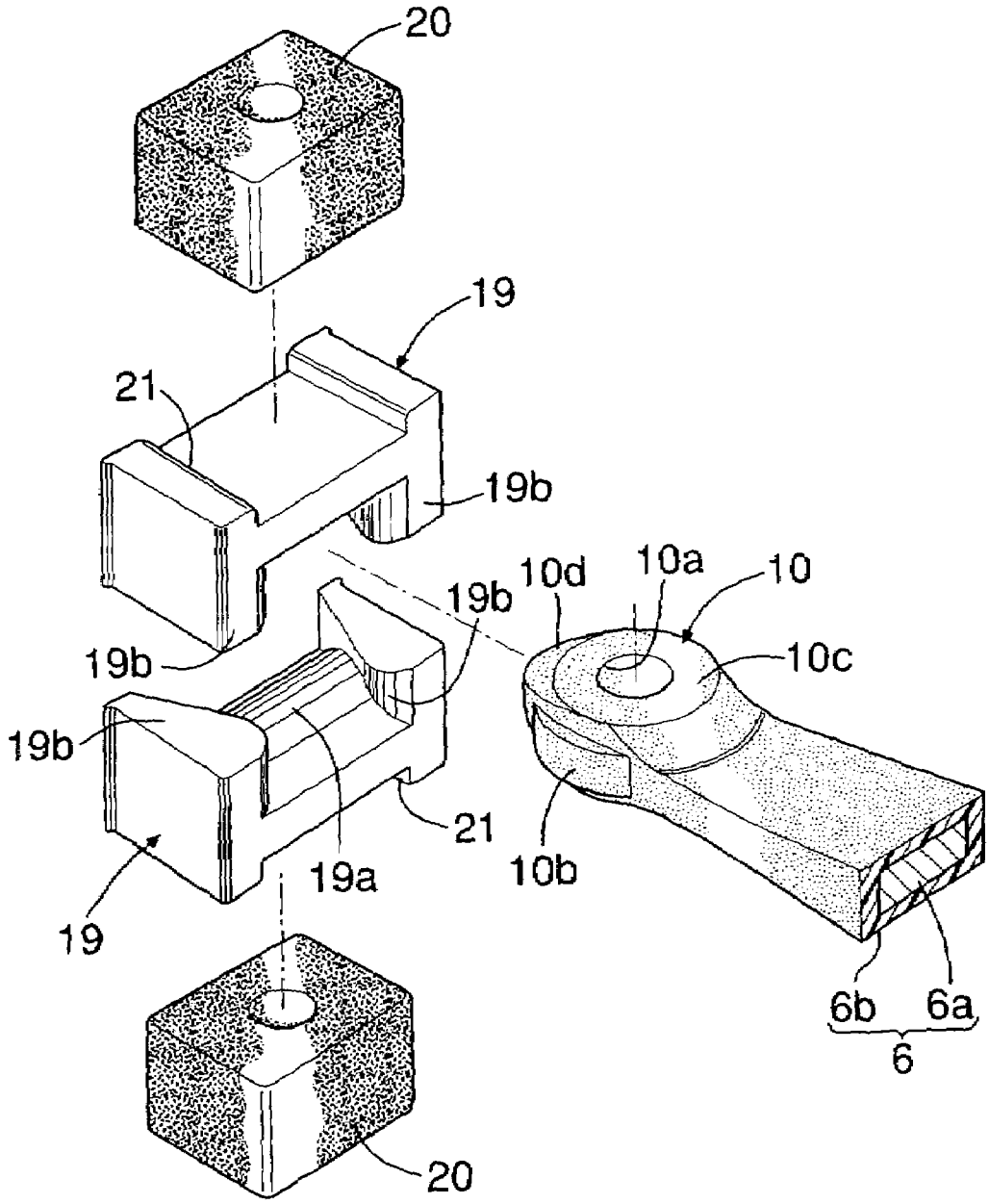
FIG. 9 is an exploded perspective view of an essential portion of the door checker.

In FIGS. 4, 6 and 7, the boss 10 is formed to have a diameter D larger than the width W of the detent surfaces 9, 9. Therefore, the peripheral surface of the boss 10 projects from both the side surfaces of the check lever 6. The pair of side projecting portions are denoted by reference symbols 10*b*, 10*b*. On the other hand, the through holes 3 to 5 in the door D and the case 1 are formed to have a size capable of allowing the boss 10 to pass therethrough.

Also, on opposite end surfaces in the axial direction of the boss 10, there are formed a pair of expanding portions 10*c*, 10*c* which can pass between the pair of guide walls 19*b*, 19*b*. When the expanding portions 10*c*, 10*c* pass between the pair of guide walls 19*b*, 19*b*, the side projecting portion 10*b* can pass between the pair of shoes 19, 19. The expanding portions 10*c*, 10*c* are molded integrally with the skin 6*b*.

Further, the boss 10 is formed with a wedge-shaped portion 10*d* for widening a clearance between the pair of shoes 19, 19 when the boss 10 is inserted between the pair of shoes 19, 19. The wedge-shaped portion 10*d* is also molded integrally with the skin 6*b*.

Next, the operation of this embodiment will be explained.

Figure 10A:
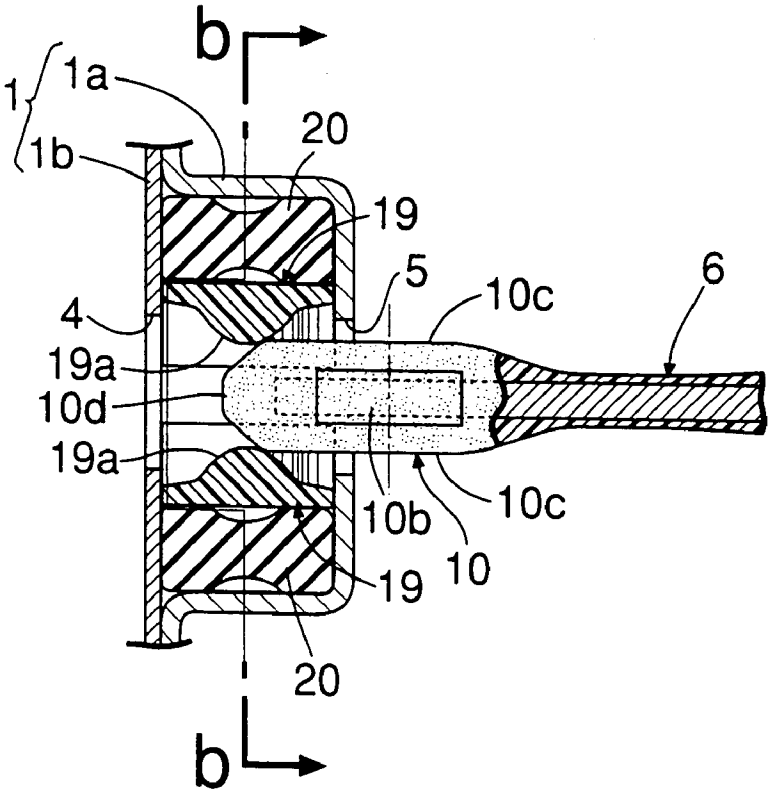
FIGS. 10A, 10B and 10C are views for illustrating the operation at an assembly stage of the door checker.
Figure 10B:
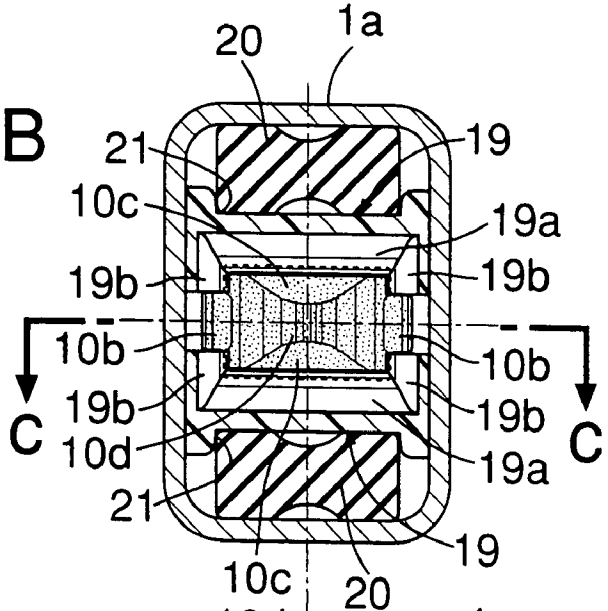
Figure 10C:
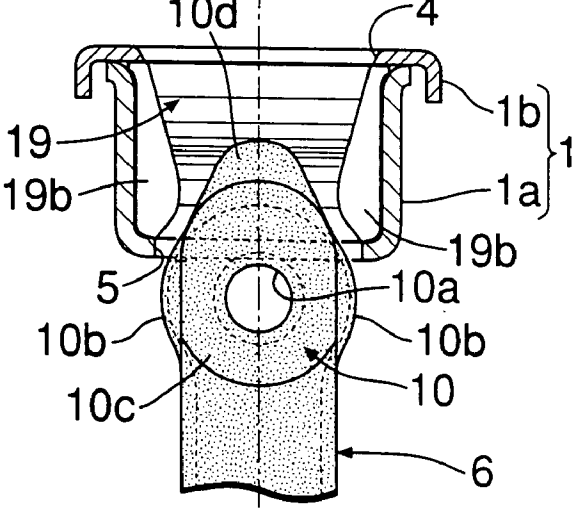

In assembling the door checker C, first, the shoes 19, 19 and the rubber springs 20, 20 are put in the case body 1*a*, and then the cover 1*b* is connected to the case body 1*a*. Next, as shown in FIGS. 10A, 10B and 10C, the check lever 6 is pushed in between the pair of shoes 19, 19 through the through hole 5 in the case body 1*a*, with the wedge-shaped portion 10*d* of the boss 10 at the head of the check lever 6. Since the wedge-shaped portion 10*d* smoothly widens the clearance between the pair of shoes 19, 19 while compressing the rubber springs 20, 20, the expanding portions 10*c*, 10*c* of the boss 10 following the wedge-shaped portion 10*d* can be inserted easily between the shoes 19, 19.

Figure 11A:
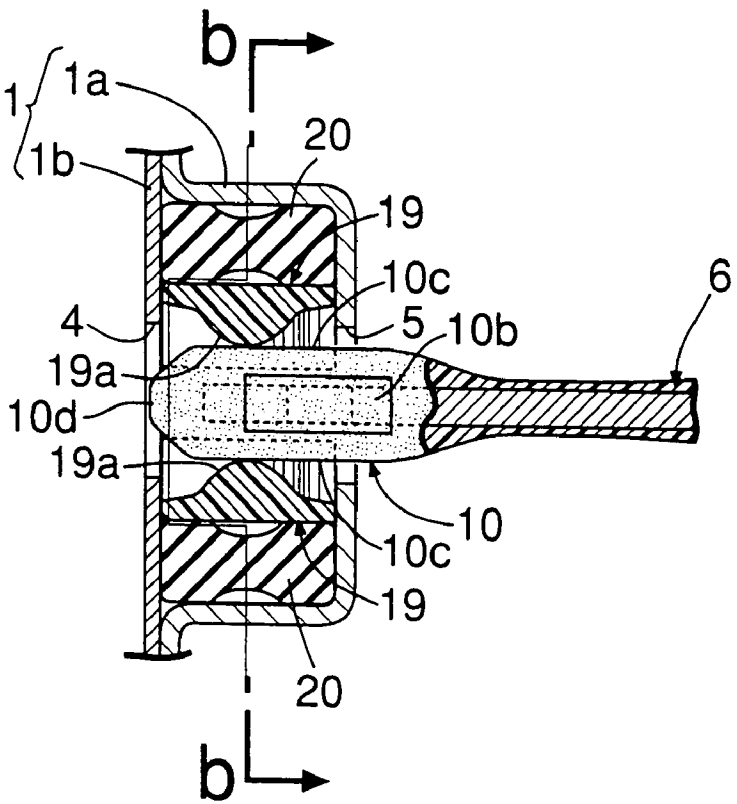
FIGS. 11A, 11B and 11C are views for illustrating the operation at another assembly stage.
Figure 11B:
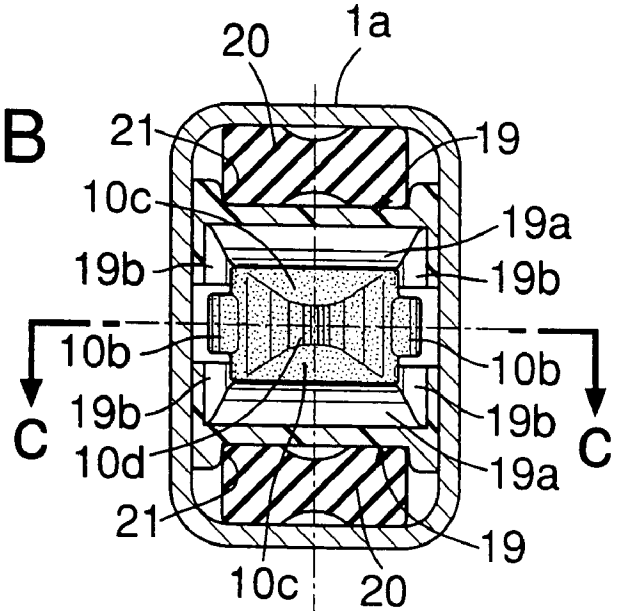
Figure 11C:
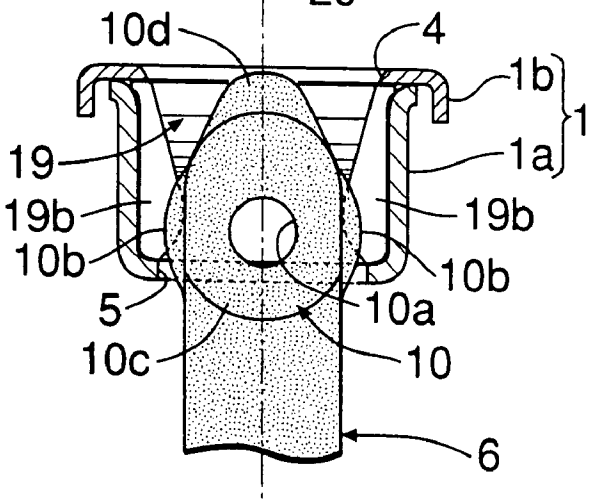

After the expanding portions 10*c*, 10*c* of the boss 10 have been inserted between the shoes 19, 19, the side projecting portions 10*b*, 10*b* of the boss 10 can pass between the shoes 19, 19 without being interfered by the guide walls 19*b*, 19*b* as shown in FIGS. 11A, 11B and 1C. Therefore, by further pushing the check lever 6 in between the shoes 19, 19, the boss 10 is allowed to pass between the shoes 19, 19, and further pass through the through hole 4 in the cover 1*b*. To the boss 10 having passed through the cover 1*b*, the bracket 7 is connected via the shaft 8.

In the full open stopper 12, since the bulging portion 15 that wraps the anchor pin 14 is molded integrally with the synthetic resin skin 6B of the check lever 6, the full open stopper 12 can be constructed simultaneously with the manufacture of the check lever 6. Therefore, when the door checker C is assembled, the number of assembling steps can be decreased by eliminating a process of installing the full open stopper 12. Moreover, the bulging portion 15 is used not only as a stopper plate but also as an element for preventing the anchor pin 14 from coming off from the core plate 6*a*. Therefore, the number of parts is decreased, and the structure is simplified, which effectively reduces the cost owing to the reduced number of assembling steps.

Furthermore, although the boss 10 of the check lever 6 has a diameter larger than the width W of the detent surface 9, as described above, the wedge-shaped portion 10*d* guides the expanding portions 10*c*, 10*c* to a position between the shoes 19, 19, and causes the boss 10 to pass between the shoes 19, 19 smoothly while avoiding the interference between the side projecting portions 10*b*, 10*b* and the guide walls 19*b*, 19*b* of the shoes 19, 19. Therefore, the assemblability of the door checker C is high. By forming the boss 10 so as to have a diameter larger than the width W of the detent surface 9, the diameter of the shaft hole 10*a* in the boss 10 is made as large as possible to enable the use of the shaft 8 having as large diameter as possible, whereby a sufficient connection strength can be ensured between the check lever 6 and the bracket 7.

In installing the door checker C to the body B of an automobile: the door checker C with the bracket 7 is inserted into the door D through an opening (not shown) in an inner panel of the door D; the bracket 7 is pulled out to the outside through the through hole 3 in the end wall of the door D; and the case 1 is fixed to the end wall of the door D with the bolts 2, 2. Then, the bracket 7 is fixed at a predetermined position of the body B with the bolts 11, 11, whereby the installation work is finished.

When the door D is open from the closed state, the engagement portions 19*a*, 19*a* of the shoes 19, 19 slidingly climb the upgrade detent surfaces 9, 9 of the check lever 6, and accordingly the rubber springs 20, 20 are compressed.

Therefore, the pressing force of the shoes 19, 19 on the detent surfaces 9, 9 is increased by an increase in the resilience of the rubber springs 20, 20, and accordingly the opening torque of the door D properly increases.

When the door D is opened to a predetermined half open position, the engagement portions 19*a*, 19*a* of the shoes 19, 19 fall into the half open detent notches 9*a*, 9*a* on the detent surfaces 9, 9, whereby the door D can be held at the predetermined half open position.

When an opening force is further applied to the door D to cause the engagement portions 19*a*, 19*a* of the shoes 19, 19 to get out of the half open detent notches 9*a*, 9*a*, the engagement portions 19*a*, 19*a* fall into the full open detent notches 9*b*, 9*b*, and at the same time, the full open stopper 12 is received by the case 1, whereby the door D is stopped and held at the full open position. At this time, the opening force of the door D is transmitted to the bulging portion 15 made of a synthetic resin after being absorbed by the cushion member 16. Since the bulging portion 15 is effectively reinforced by the anchor pin 14 which is fitted on the core plate 6*a* and embedded in the bulging portion 15, and the reinforcing rib 15*a* formed on the back face of the bulging portion 15, the bulging portion 15 can firmly receive the opening force of the door D.

The present invention is not limited to the above-described embodiment, and various design changes can be made without departing from the subject matter of the invention. For example, as the engagement portion 19*a* of the shoes 19, 19, a roller may be mounted, and in place of the rubber springs 20, 20, metallic springs may be used. Also, in place of the hollow anchor pin 14, a solid pin, or a prismatic or plate-shaped anchor member may be used.

What is claimed is:

1. A door checker for an automobile, comprising:

a check lever having a proximal end portion connected, via a shaft, to a bracket fixed to a body of the automobile;

a case through which the check lever passes and which is fixed to a door hinge-connected to the body;

a shoe housed in the case and in sliding contact with detent surfaces of the check lever; and elastic members housed in the case and which urge the shoe toward the detent surfaces, wherein the check lever includes:

a core plate and a skin mold-connected to a peripheral surface of the core plate; and a full open stopper which contacts an external end wall of the case to define a full open position of the door and which is provided in a distal end portion of the check lever, wherein the full open stopper includes:

an anchor member disposed to pass through an anchor aperture formed in a distal end portion of the core plate; and a bulging portion integrally formed with the skin of the check lever and encompassing the anchor member.

* * * * *